United States Patent [19]

Shirley

[11] Patent Number: 4,622,870

[45] Date of Patent: Nov. 18, 1986

[54] OPEN-END RATCHET-LIKE WRENCH WITH RELEASABLE LOCKING HEAD

[76] Inventor: Gerald Shirley, 133 Sagamore Rd., Tuckahoe, N.Y. 10707

[21] Appl. No.: 737,275

[22] Filed: May 23, 1985

[51] Int. Cl.[4] ..... B25B 13/00

[52] U.S. Cl. ..... 81/58.2; 81/60

[58] Field of Search ..... 81/58, 58.1, 58.2, 60

[56] References Cited

U.S. PATENT DOCUMENTS

| | | | |
|---|---|---|---|
| 916,017 | 3/1909 | Reynolds | 81/58.2 X |
| 1,554,964 | 9/1925 | Fisher | 81/77 |
| 2,615,358 | 10/1952 | Garno | 81/77 X |
| 2,787,180 | 4/1957 | Fish | 81/57 |
| 2,842,995 | 7/1958 | Johnson . | |
| 2,851,914 | 9/1958 | Zeckzer . | |
| 2,954,715 | 10/1960 | Wycech . | |
| 3,067,641 | 12/1962 | Ricci | 81/61 |
| 3,175,434 | 3/1965 | Bergquist | 81/58.2 |
| 3,386,319 | 6/1968 | Bloom . | |
| 3,448,641 | 6/1969 | Morrow | 81/58.2 |
| 3,504,579 | 4/1970 | Harlan | 81/58.2 |
| 3,535,960 | 10/1970 | Borries | 81/57.14 |
| 3,927,582 | 12/1975 | Hertelendy et al. | 81/58.2 |
| 3,945,274 | 3/1976 | Annett | 81/58.1 |

*Primary Examiner*—James G. Smith

*Attorney, Agent, or Firm*—Martin A. Levitin

[57] ABSTRACT

A two way open-end wrench has a rotatable, captive, split socket which is selectively locked and unlocked to the wrench handle for torque transmittal through the meshing engagement of two opposed sets of teeth. One set is disposed around the periphery of the open-sided socket member and the other within the forward, concave end of a spring-loaded coupler disposed partly within and partly outside the wrench body. Engagement of the teeth is effected by the inward movement of the coupler when a user grips the wrench handle preparatory to turning it. Relaxation of the grip at the end of a stroke permits the handle to be returned to the starting position while the socket remains stationary. A projecting extension on the socket provides for manual rotation to the open position, permitting the tool to be withdrawn from a fastener on a tubing line, pipe or cable.

7 Claims, 6 Drawing Figures

FIG. 4
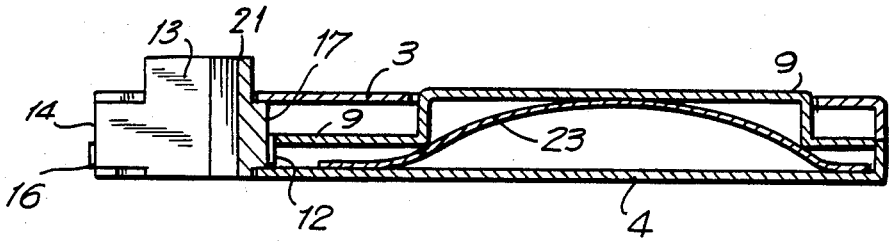
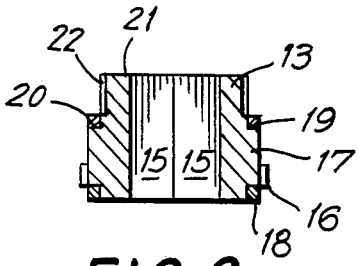
FIG. 6
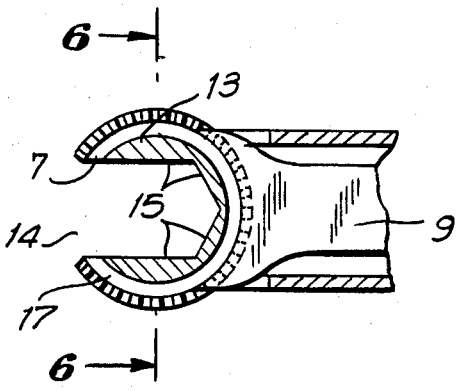
FIG. 5

OPEN-END RATCHET-LIKE WRENCH WITH RELEASABLE LOCKING HEAD

FIELD OF THE INVENTION

This invention relates generally to hand tools and more particularly to open-ended two-way wrenches with removable open sockets and means for locking and unlocking the head to the wrench handle.

BACKGROUND OF THE INVENTION

In the fields of mechanical, hydraulic, pneumatic, electrical, etc. equipment it is a universal practice to assemble component parts with threaded fasteners, the most familiar and commonly used ones being nuts and bolts. During initial assembly these fasteners must be tightened, and later must sometimes be loosened or removed in order to effect repairs and/or install new parts. It is axiomatic that speed in the turning of threaded fasteners is desirable because this saves time and thus money. To this end "speed wrenches", both powered and manual, providing continuous or progressive stepped rotation of fasteners have been developed and are widely marketed. In the manual category there are two basic types, designated as ratcheting box wrenches and socket ratchet wrenches. Both employ full-circle or closed socket gripping members which completely surround the periphery of a fastener, which may be a nut or a bolthead, and which most commonly are hexagonal.

There are frequent situations where either a space limitation or the presence of a tubular line, pipe or cable projecting through the center of a nut makes it impossible to apply a closed socket tool, and an open-end wrench must perforce be used. If it is a simple one-piece tool the user must remove and reapply it many times before the turning is completed, and where there is little room for movement of the handle it is often necessary to flip the wrench over between successive applications. This is a time-consuming, unwelcome and uneconomic task.

It is thus apparent that a need should exist for a ratcheting or continuously rotatable wrench which is the open-end counterpart to a conventional ratcheting box wrench or socket ratchet wrench. For maximum utility it should be as compact as possible, preferably not larger than its closed socket equivalent. To be commercially successful it must be capable of being manufactured at relatively low cost, and must be reliable in operation, as well as durable. A necessary feature, if the wrench is to be used on flare nuts and the like, is some means whereby upon completion of the turning action the socket member can be easily rotated to its open position, thereby allowing the tool to be removed from the work piece.

While open-end ratchet-type wrenches are generally known in the prior art, non are known to have met with any significant commercial success since they all suffer from one or another or combination of various drawbacks related to size, durability, complexity, ease of use or manufacturing cost. These drawbacks exist because of their universal use of traditional ratchet mechanisms utilizing pawls, pivot pins, springs and teeth, which always operate in the main X-Y or rotating plane of the wrench.

It is accordingly a principal object of the present invention to overcome the disadvantages of the prior art by providing a novel two-way, open-end, continuously rotatable ratchet-type manual wrench in which the torque-transmitting elements are fewer, simpler and stronger, and which operate in the Z or transverse plane. Thus, the various disadvantages of prior mechanisms are avoided while attaining the necessary and desirable features enumerated above. A further advantage of the invention is that at only slight additional cost the wrench can be made double-ended, so as to accommodate two different sizes of fasteners. Still another advantage is that is can be used as a universal driving handle into which variously sized split inserts or sockets can be placed, thus making the tool the open-end equivalent of a conventional socket ratchet wrench.

Other objects of the present invention are to provide an open-end manual wrench which allows for easy and rapid rotation of threaded fasteners, provides two-way action, is inexpensive to manufacture, is inherently strong and durable, contains a minimum number of parts, provides means for easily moving the socket member to its open position, can be produced in double-ended, two-size versions and can be used as a universal driving handle with variously sized open-size socket inserts.

The above and other features, objects and advantages of the invention will become more apparent from the following description and claims in connection with the accompanying drawings to be described hereinafter.

SUMMARY OF THE INVENTION

Briefly described, the invention provides a wrench having a handle and head both of hollow cross section, the head terminating in fixed, open, arcuate jaws. A cylindrical, open-sided socket member is captively and rotatably carried within the jaws. A row of teeth is provided on the periphery of the socket symmetrically arranged thereabout, occupying a vertical area which is a fraction less than the lower half of the socket's surface between upper and lower jaw plates. An elongate coupler member is disposed internally within the wrench head and within the forward and rear ends of the wrench handle. A longitudinal opening or slot in one side of the handle is provided. The body of the coupler is formed to provide an elongate, raised, flat portion which projects outwardly through the opening or slot. The slidable engagement between the sides of the raised portion and the opening permits the free inward and outward movement of the coupler but prevents its longitudinal or sideways movement. A leaf spring disposed internally between the raised portion and the bottom wall of the handle urges the coupler outwardly. The forward end of the coupler has a thickness which is slightly less than one half the distance between the jaw plates and terminates in an arcuate rim in which are formed a row of downward pointing teeth of the same shape and size as those on the socket periphery arranged for engagement with the teeth on the socket. The arcuate length of the teeth row on the end of the coupler is greater than the arcuate length of the gap between the teeth on the socket, thus ensuring that regardless of the socket's rotational orientation on adequate number of teeth will always be engageable. A small raised extension on the top of the socket, having a rough surface, projects above the top surface of the wrench head, and provides fingergrip means for easily turning the socket to its normal open starting position.

In employing the wrench a user slides it onto a fastener, firmly grips the handle and then turns it. The gripping action moves the coupler inward causing the two sets of teeth to mesh fully, thus locking the socket to the handle for positive torque transmittal. At the end of a stroke the user relaxes his grip slightly, allowing the teeth to unmesh, and moves the handle back to its starting position. At the conclusion of a tightening or loosening sequence, if the fastener is a flare nut the user slides the wrench axially off the nut and then manually rotates the socket to its open position, permitting the wrench to be withdrawn from the tubing, conduit or cable on which the nut is mounted.

BRIEF DESCRIPTION OF THE DRAWINGS

The foregoing and other features of the present invention are more fully described with reference to the following drawings annexed hereto, in which:

FIG. 4 is a side sectional view similar to that of FIG. 2 illustrating the invention in a condition for use with the coupler depressed causing the teeth to mesh;

FIG. 5 is a sectional view taken along lines 5—5 of FIG. 2; and

FIG. 6 is a sectional view taken along lines 6—6 of FIG. 5.

DESCRIPTION OF THE INVENTION

Figure 1:
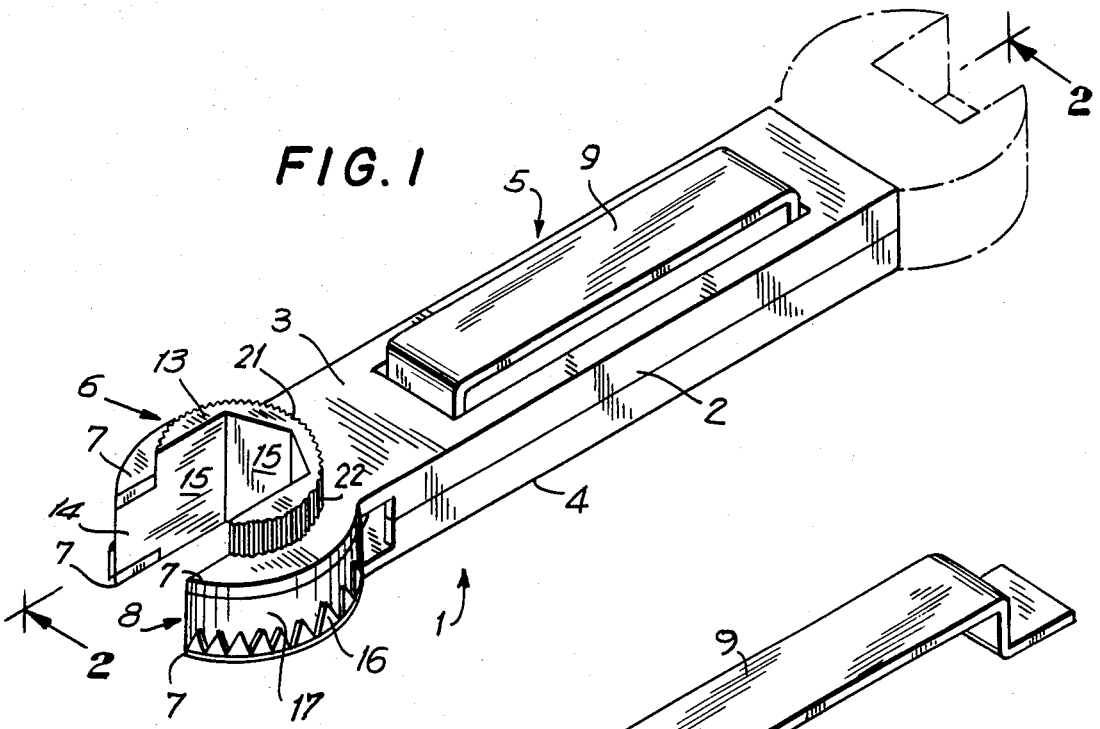
FIG. 1 is a perspective view of the present invention.
Figure 3:
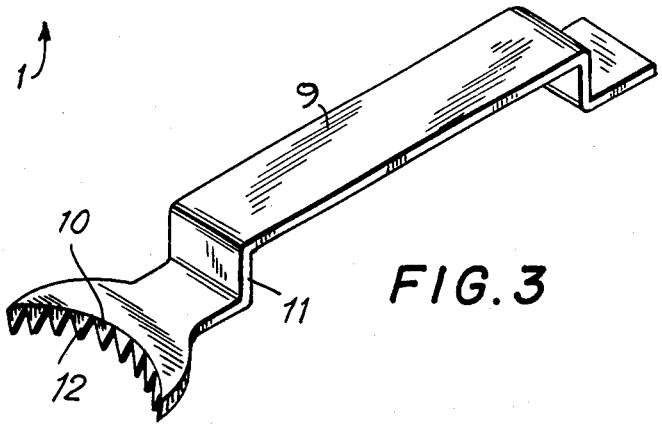
FIG. 3 is a perspective view of the coupler used in the invention.

Referring first to FIG. 1, the wrench of the present invention is generally designated by the numeral 1 and has a body 2 with top side 3 and bottom side 4. Body 2 has an elongate handle portion 5 and a head 6 including a pair of jaws 7 formed by upper and lower jaw plates defining an opening 8 therebetween.

Figure 2:
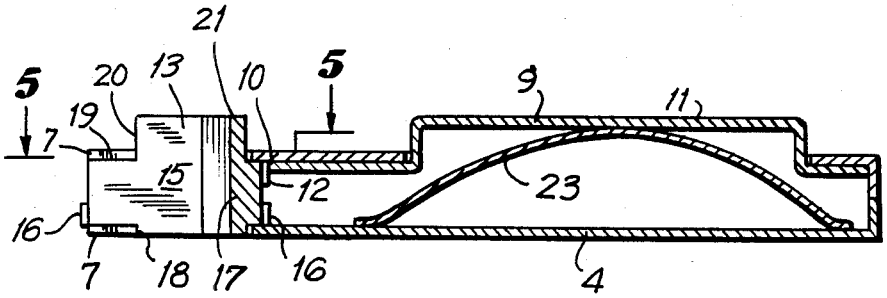
FIG. 2 is a side sectional view taken along lines 2—2 of FIG. 1 illustrating the invention in a condition in which the teeth are unmarked.

As best seen in FIG. 2, a coupler 9 has a forward concave rim 10 in which are formed downward-facing teeth 12. Intermediately along the body of coupler 9, a series of four right angle bends provides a raised elongate portion 11.

As seen in FIG. 6, a socket member 13, having one open side 14, is captively and rotatably seated within jaws 7. Socket 13 is provided with at least two work-engaging surfaces 15 but in the preferred embodiment shown has four, being thus optimally adapted for use on hexagonal shaped fasteners, which are the most commonly used variety. In an embodiment designed for use exclusively on square nuts and boltheads the cental socket opening would have three work-engaging surfaces at right angles to each other.

Socket 13 has a hub 17 between the top and bottom jaw plates that comprises jaws 7. A row of upwardly-pointing teeth 16 extends around the periphery of hub 17, interrupted by the gap of opening 14. Teeth 16 are symmetrically shaped and their apexes lie in a plane just below the middle of hub 17.

Socket 13 has a bottom hub 18 whose diameter may be the same as or smaller than that of hub 17. Hub 18, the bottom surface of teeth 16 and the bottom circuate opening of jaws 7 cooperate to form a bearing which permits the free rotation of socket 13 while preventing its downward axial movement.

A shoulder 19 at the upper end of hub 17 provides an upper hub 20 which in cooperation with the upper circuate opening of jaws 7 forms a bearing which gives rotational freedom to socket 13 while preventing its upward axial movement.

Extending upwardly from socket 13 there is an open-sided member 21 with a roughened surface 22. This extension is a finger-grip means whereby socket 13 can be easily turned to any desired angular position. In the embodiment shown the external surface is shown as circular, but it could also be made in hexagonal form, whereby there would be four flat sides extending upwardly from the socket body.

As best seen in FIGS. 2 and 4, coupler 9 is urged outwardly by leaf spring 23 which is held between the "ceiling" of raised portion 11 and the "floor" of handle bottom side 4. When coupler 9 is in its normal, outward raised position there is a small clearance between the front edges of teeth 12 and the upper half of the surface of hub 17.

It is possible to construct a wrench according to the present invention utilizing square teeth, but this would not be a practical embodiment since the necessity of bringing the two sets of teeth into exact alignment each time before the user could mesh the teeth would greatly slow down the operation. If the opposing corners of square teeth are chamferred this lessens the alignment requirement, and the larger the chamfer the less the problem. This leads to the obvious conclusion that the optimal shape of the engaging end of the tooth, if not the entire tooth, is triangular. With triangular teeth the alignment problem becomes insignificant.

The choice of included angle simultaneously controls the tooth count—i.e. the narrower the angle the greater the number of teeth. The optimum range of included angles probably extends from approximately 50 to 90 degrees.

When teeth 12 and 16 are engaged it can be seen that socket 13 is effectively locked to handle 5, and that rotational torque can be transmitted to a fastener either clockwise or counterclockwise. Thus the wrench of the present invention is inherently a two-way mechanism. Most, if not all, other two-way ratchet wrenches require the presence of additional parts to provide two-way action, which increases complexity and manufacturing cost, while one-way wrenches inconveniently require the user to remove the wrench from the fastener, turn it over, and then reapply it.

As can be seen in FIG. 1, wherein phantom jaws and socket are at the opposite end of the handle, the wrench of the present invention can be made double-ended, thus permitting the tool to be used on two different sizes of fasteners. Coupler 9 simultaneously engages or disengages from both sockets.

External, interchangeable, variously-sized, open-side sockets having an axially-extending open-side portion shaped to slideably engage the inside surfaces 15 of socket 13, enable the wrench to function as a universal ratcheting driver handle for use on a range of fasteners of various sizes and shapes. It thus serves as an open-end equivalent of a conventional (closed) socket ratchet wrench set.

Any socket used with the wrench of the present invention, whether an integral member, as for example socket 13, or external insertable sockets, can be made with a split-hexagonal opening in the manner of so-called "flare wrenches", whereby the driving engagement and torque is applied equally at six points on a hexagonal flare nut, thus minimizing the danger of physically distorting such nuts which often have thin walls.

What is claimed is:

1. An open-end wrench comprising a hollow handle, a head having an opening end connected to said handle at one end thereof which head comprises a pair of jaws formed by upper and lower jaw plates defining an opening there-between, a socket member rotatably carried within said head for rotation in two opposite directions, said socket member formed by a generally cylindrical body being opened at both ends thereof, being supported within said opening for rotation between said jaw plates and having a section of its cylindrical wall open to coincide with the open-end of said head, said socket member comprising a main hub for engaging said jaw plates and for preventing axial movement of said socket member with respect to said head and having means for engaging a workpiece, and manually operable means carried by said handle for selectively engaging said socket member when said handle is normally gripped in the hand of a user to prevent rotation of said socket member within said head, said manually operable means comprising a spring-loaded coupler movable between an inoperative position and an operative position, said coupler extending through an opening in said handle when in the inoperative position and arranged to be depressed against the action of said spring loading into said operative position when said handle is gripped by a user, socket member engaging means carried by said coupler for engaged said socket member, engaging means carried by said socket member when said coupler is depressed into said operative position within said handle to thereby prevent rotational movement of said socket member within said head.

2. The open-end wrench according to claim 1 wherein said opening in said handle is a longitudinal slot, said coupler comprising a raised elongate portion adapted to extend through said slot, and wherein said spring-loaded coupler means is formed by a leaf spring supported between the inside facing surface of said raised portion of said coupler and said handle for urging said coupler into said inoperative position extending through said slot.

3. The open-end wrench according to claim 1 wherein said engaging means comprises a plurality of teeth axially directed and arranged about the periphery of said hub, and wherein said socket member engaging means comprises a plurality of teeth arcuately arranged at an end of said coupler for engaging said teeth of said socket member when said coupler is in the operative position and disengaged therefrom when said coupler is in the inoperative position.

4. The open-end wrench according to claim 3 wherein the apexes of said teeth carried by said socket lie in a plane offset from the axial center of said main hub, and wherein the apexes of said teeth carried by said coupler are spaced from the apexes of the teeth carried by said socket member when said coupler is in the inoperative position.

5. The open-end wrench according to claim 3 wherein the angle of inclusion of said teeth carried by said socket member and by said coupler is between 50 degrees and 90 degrees.

6. The open-end wrench according to claim 1 further comprising an extension supported by said socket member to provide finger gripping means so that said socket member may be manually rotated within said head to permit engagement with an removal from a workpiece.

7. The open-end wrench according to claim 1 further comprising a second head connected to the end of said handle opposite said first head, a second socket member rotatably carried within said second head, said second socket member being formed substantially the same as said socket member for engaging a workpiece of a different size than said workpiece, said manually operable means arranged for simultaneously selectively preventing rotation of said socket within said head and of said second socket within said second head.

* * * * *